US006501072B2

(12) United States Patent
Mullins et al.

(10) Patent No.: US 6,501,072 B2
(45) Date of Patent: Dec. 31, 2002

(54) METHODS AND APPARATUS FOR DETERMINING PRECIPITATION ONSET PRESSURE OF ASPHALTENES

(75) Inventors: Oliver C. Mullins, Ridgefield, CT (US); Abul Jamaluddin, League City; Nikhil B. Joshi, Houston, both of TX (US)

(73) Assignee: Schlumberger Technology Corporation, Ridgefield, CT (US)

( * ) Notice: Subject to any disclaimer, the term of this patent is extended or adjusted under 35 U.S.C. 154(b) by 10 days.

(21) Appl. No.: 09/772,209

(22) Filed: Jan. 29, 2001

(65) Prior Publication Data

US 2002/0139929 A1 Oct. 3, 2002

(51) Int. Cl.[7] ..... G01N 15/02

(52) U.S. Cl. ..... 250/256; 250/255; 250/269.1; 250/301; 250/399.07; 356/335; 356/336; 356/441; 356/442

(58) Field of Search ..... 250/256, 269.1, 250/301, 339.07, 255; 356/441, 442, 335, 336

(56) References Cited

U.S. PATENT DOCUMENTS

| | | | | |
|---|---|---|---|---|
| 3,780,575 A | | 12/1973 | Urbanosky | 73/152 |
| 3,859,851 A | | 1/1975 | Urbanosky | 73/155 |
| 4,860,581 A | | 8/1989 | Zimmerman et al. | 73/155 |
| 4,936,139 A | | 6/1990 | Zimmerman et al. | 73/155 |
| 4,994,671 A | | 2/1991 | Safinya et al. | 250/255 |
| 5,245,318 A | * | 9/1993 | Tohge et al. | 340/611 |
| 5,266,800 A | | 11/1993 | Mullins | 250/256 |
| 5,859,430 A | | 1/1999 | Mullins et al. | 250/255 |
| 5,939,717 A | | 8/1999 | Mullins | 250/255 |

OTHER PUBLICATIONS

Chandraeskhar, S. *Selected Papers on Noise and Stochastic Process*. Edited by Nelson Wax. Dover Publications, Inc., New York (1954) pp. 22–29.

Kerker, Milton. *The Scattering of Light and Other Electromagnetic Radiation*. Academic Press, New York (1969) pp. 338–343.

Mullins, Oliver C. and Sheu, Eric Y. *Structures and Dynamics of Asphaltenes*. Plenum Press Press, New York (1998) Ch 1, pp. 1–20.

Sheu, Eric Y. and Mullins, Oliver C. *Asphaltenes, Fundamentals and Applications*. Plenum Press, New York (1995) Ch 1, pp. 1–4.

* cited by examiner

*Primary Examiner*—Constantine Hannaher
*Assistant Examiner*—Timothy Moran
(74) *Attorney, Agent, or Firm*—David P. Gordon; Jody Lynn DeStefanis; William B. Batzer

(57) ABSTRACT

The optical density of an oil sample at a plurality of wavelengths over a plurality of different (typically decreasing) pressures is monitored and used to find the size of agglomerated asphaltene particles which are precipitating from the oil sample. The optical density information used in finding the particle size is preferably optical density information relating to the scattering of light due to the asphaltene particles only. Thus, baseline optical density information of the oil sample at a high pressure is subtracted from optical density information obtained at test pressures at each wavelength of interest. Asphaltene particles of a radius of one micron and smaller were found to be powdery, while asphaltene particles of a radius of three microns and larger were found to include paving resins. The precipitation of asphaltenes is reversible by increasing the pressure under certain circumstances.

63 Claims, 6 Drawing Sheets

METHODS AND APPARATUS FOR DETERMINING PRECIPITATION ONSET PRESSURE OF ASPHALTENES

The present invention is related to co-owned U.S. Pat. Nos. 3,780,575 and 3,859,851 to Urbanosky, co-owned U.S. Pat. Nos. 4,860,581 and 4,936,139 to Zimmerman et al., co-owned U.S. Pat. No. 4,994,671 to Safinya et al. and co-owned U.S. Pat. Nos. 5,266,800, 5,859,430, and 5,939,717 to Mullins, all of which are hereby incorporated by reference herein in their entireties. The invention is also related to co-owned copending U.S. application Ser. No. 09/395,141 filed Sep. 14, 1999, and U.S. application Ser. No. 09/604,440, both of which are hereby incorporated by reference herein in their entireties.

BACKGROUND OF THE INVENTION

1. Field of the Invention

The invention relates to methods and apparatus for determining, both uphole and downhole, the properties of oil. The invention more particularly relates to methods and apparatus for determining the precipitation onset pressure of certain asphaltenes. The invention has particular application to both oilfield exploration and production, although it is not limited thereto.

2. State of the Art

One of the problems encountered in crude oil production is asphaltene plugging of an oil well. Asphaltenes are components of crude oil that are often found in colloidal suspension in the formation fluid. If for any reason the colloidal suspension becomes unstable, the colloidal particles will precipitate, stick together and, especially in circumstances where the asphaltenes include resins, plug the well. Asphaltene precipitation during production causes severe problems. Plugging of tubing and surface facilities disrupts production and adds cost. Plugging of the formation itself is very difficult and expensive to reverse, especially for a deep water well.

Asphaltenes can precipitate from crude oils during production of the crude oil due to a drop in pressure. Crude oils which are somewhat compressible are particularly susceptible to this effect because the reduction in dielectric constant per unit volume which accompanies fluid expansion causes the asphaltene suspension to become unstable.

Asphaltenes are colloidally suspended in crude oils in micelles which are approximately 5 nm in diameter (See Asphaltenes, Fundamentals and Applications," E. Y. Sheu, O. C. Mullins, Eds., Plenum Pub. Co. New York, N.Y. 1995). With pressure reduction or addition of light hydrocarbons, the suspension can become unstable such that colloidal asphaltene particles stick together and flocculate or precipitate out of the solution.

The onset of asphaltene precipitation is difficult to predict, and when asphaltene plugging happens, it usually happens unexpectedly. Advance warning of asphaltene precipitation based on laboratory testing of formation fluid according to present techniques, while useful, is not optimally reliable.

Previously incorporated co-owned U.S. Ser. No. 09/395,141 to Mullins et al. discloses the use of the fluorescence-quenching properties of colloidally dispersed asphaltenes in determining the onset pressure of asphaltene precipitation. In particular, it was found that as asphaltenes precipitated out of the oil, the fluorescence of the oil increased. Thus, by changing the pressure on the oil sample, measuring the intensity of fluorescence at one or more wavelengths, and detecting a change either in intensity or in spectral shift of intensities across the spectrum of the fluorescence, the onset pressure of asphaltene precipitation could be found. It was also found that a downhole optical transmission measurement technique could be used to find the onset pressure, by finding a change in the total optical transmission of light through an optical cell.

While the methods of U.S. Ser. No. 09/395,141 are extremely useful, it has been determined by the inventors that the fluorescence-quenching technique is not as robust as might be desired, because only a small percentage of the asphaltenes present in the oil precipitate out of the oil at the onset pressure. Likewise, the optical transmission measurement technique is not as robust as might be desired because the change in total light transmission due to asphaltene precipitation is not specific. In addition, while the methods of U.S. Ser. No. 09/395,141 are useful in finding the asphaltene precipitation onset pressure, it appears that asphaltene precipitation does not in all cases lead to asphaltene plugging.

SUMMARY OF THE INVENTION

It is therefore an object of the invention to provide methods and apparatus for determining the precipitation onset pressure of sticky asphaltenes.

It is another object of the invention to provide robust methods for finding the precipitation onset pressure for asphaltenes of different particle sizes.

It is a further object of the invention to provide both uphole (laboratory) and downhole (borehole/wellbore) methods for finding the onset pressure of resin-containing asphaltenes which utilize optical measurements.

In accord with the objects of the invention which will be discussed in more detail below, the preferred embodiment of the method invention generally includes monitoring the optical density of an oil sample at a plurality of wavelengths over a plurality of different (typically decreasing) pressures, and using the optical density information to find the size of agglomerated asphaltene particles which are precipitating from the oil sample. Preferably, the optical density information used in finding the particle size is optical density information relating to the scattering of light due to the asphaltene particles only. Thus, according to the preferred embodiment of the invention, baseline optical density information of the oil sample at a high pressure is subtracted from optical density information obtained at test pressures at each wavelength of interest.

In accord with the invention, asphaltene precipitates having a diameter of approximately one micron or smaller are thought to be deficient in resins and are therefore unlikely to cause well-plugging problems. Thus, for purposes of determining precipitation onset pressures, the asphaltene particle size of interest is approximately one micron and larger. It is noted that since asphaltenes are insoluble in crude oil, it is resins which permit the asphaltenes to be suspended in the oil. Asphaltenes which have less resin attached to them are less stable, and are more likely to precipitate with smaller agglomeration sizes. Asphaltenes with more resins attached to them will tend to agglomerate to larger sizes during precipitation.

According to another aspect of the invention, additional optical density measurements are made as the pressure is increased on the sample which has already undergone precipitation, as it has been found that asphaltenes which do not have resins removed from them will reversibly re-suspend in the crude oil under certain circumstances. By making measurements in both decreasing and increasing pressure situations, and comparing the two, other optical scattering effects can be removed from the measurements, as only optical scattering from asphaltenes will follow the pressure cycling.

According to yet another aspect of the invention, a determination of the size of the asphaltene precipitates is found by using the Stokes equation which relates the particle size to the particle velocity, the viscosity of the oil, and the densities of the particles and oil. It has been found that the optical density of a precipitating sample at a given pressure will decrease over time, as the asphaltenes precipitate out. The velocity of the particles may therefore be measured by tracking a decline in the optical density of a precipitating sample over a period of time; e.g., by knowing the sample cell height, and by finding the amount of time it takes for the optical density to decline to some percentage (e.g., 1/e) of the difference between a maximum optical density and a baseline measurement.

All methods of the invention may be carried out both uphole and downhole, and if downhole, using a borehole tool or using permanently located optical cells. The Stokes equation measurement for finding the particle size, however, is most suited to uphole measurement.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
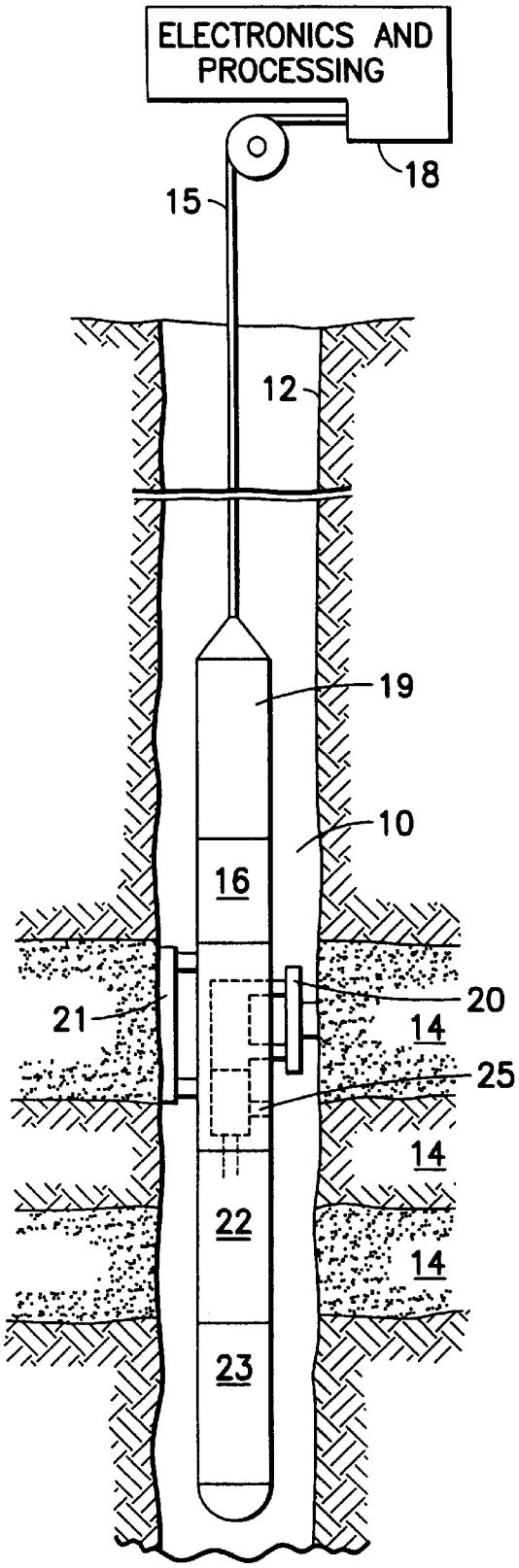
FIG. 1 is a schematic diagram of a borehole apparatus for analyzing formation fluids.

Referring now to FIG. 1, a borehole tool 10 for analyzing fluids from the formation 14 is suspended in the borehole 12 from the lower end of a typical multiconductor cable 15 that is spooled in a usual fashion on a suitable winch (not shown) on the formation surface. On the surface, the cable 15 is preferably electrically coupled to an electrical control system 18. The tool 10 includes an elongated body 19 which encloses the downhole portion of the tool control system 16. The elongated body 19 also carries a selectively extendable fluid admitting assembly 20 and a selectively extendable tool anchoring member 21 which are respectively arranged on opposite sides of the body. The fluid admitting assembly 20 is equipped for selectively sealing off or isolating selected portions of the wall of the borehole 12 such that pressure or fluid communication with the adjacent earth formation is established. Also included with tool 10 are a fluid analysis module 25 through which the obtained fluid flows. The fluid may thereafter be expelled through a port (not shown) or it may be sent to one or more fluid collecting chambers 22 and 23 which may receive and retain the fluids obtained from the formation. Control of the fluid admitting assembly, the fluid analysis section, and the flow path to the collecting chambers is maintained by the electrical control systems 16 and 18.

Additional details of methods and apparatus for obtaining formation fluid samples may be had by reference to U.S. Pat. Nos. 3,859,851 and 3,780,575 to Urbanosky, and U.S. Pat. No. 4,994,671 to Safinya et al. which are hereby incorporated by reference herein. It should be appreciated, however, that it is not intended that the invention be limited to any particular method or apparatus for obtaining the formation fluids. In fact, as will be set forth in more detail hereinafter, it should also be appreciated that the invention is intended to encompass both uphole and downhole applications, and that the downhole applications may include borehole tool and production tool type applications as well as applications where the means for "obtaining" the formation fluid-sample is fixed (e.g., cemented) downhole. In addition, because the invention is intended to be applicable to both oil exploration and oil production scenarios, it should be appreciated that the term "borehole" is intended to encompass drilled boreholes, and cased and uncased wells, while the term "borehole tool" is intended to encompass tools used in those boreholes and wells.

Figure 2:
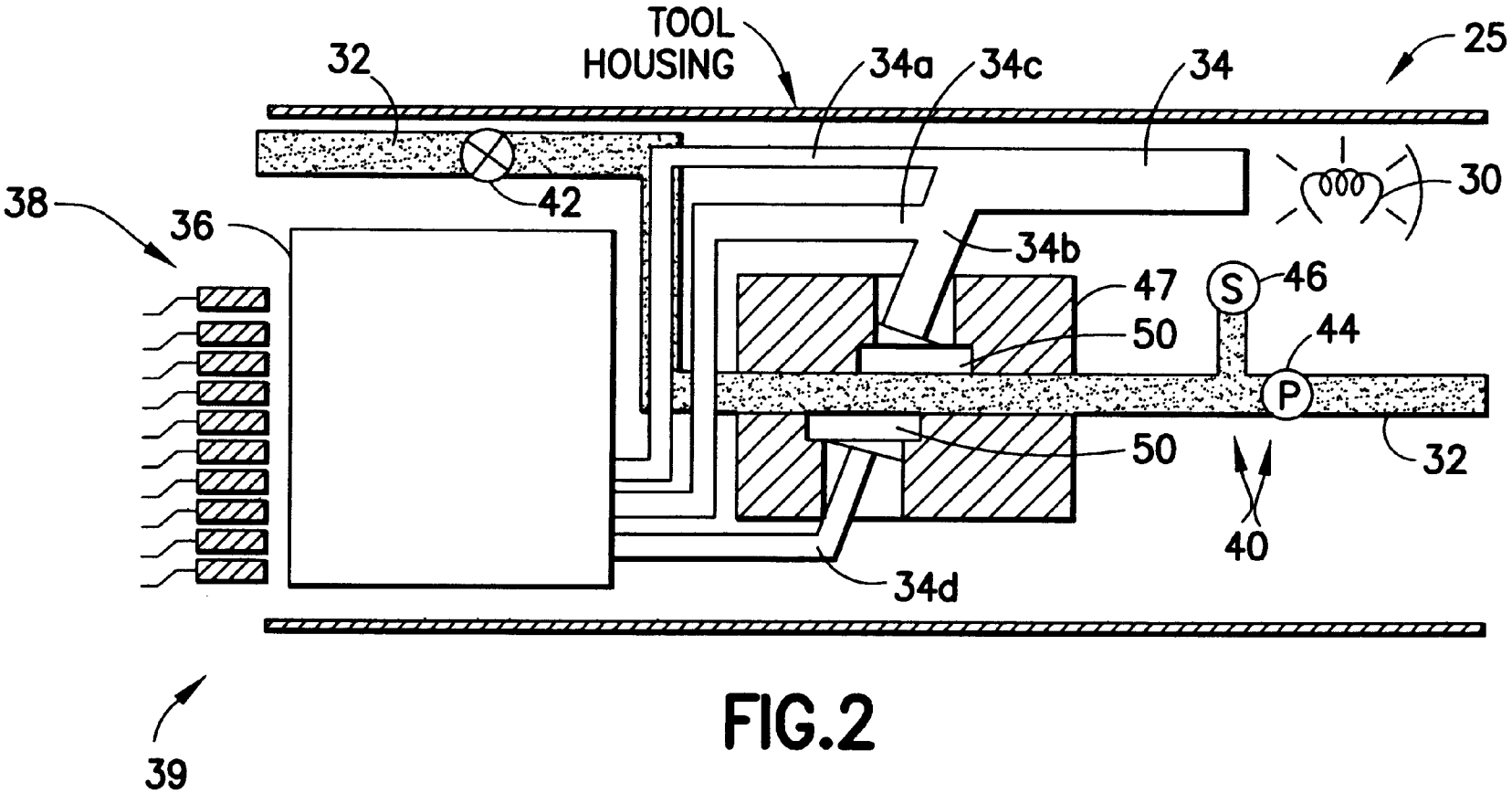
FIG. 2 is a schematic diagram of the preferred fluid analysis module of FIG. 1.

Turning now to FIG. 2, a preferred fluid analysis module 25 for use downhole includes a light source 30, a fluid sample tube 32, optical fibers 34, a filter spectrograph 39 which includes a fiber coupler or distributor 36 and an associated detector array 38, and a pressure system 40 which includes at least one valve 42, a pump 44, and a pressure sensor 46. The light source 30 is preferably an incandescent tungsten-halogen lamp which is kept at near atmospheric pressure. The light source 30 is relatively bright throughout the near infrared wavelength region of 1 to 2.5 microns (1000 to 2500 nanometers) and down to approximately 0.5 microns, and has acceptable emissions from 0.35 to 0.5 microns. Light rays from the light source 30 are preferably transported from the source to the fluid sample by at least part of a fiber optic bundle 34. The fiber optic bundle 34 is preferably split into various sections. A first small section 34*a* goes directly from the light source 30 to the distributor 36 and is used to sample the light source. A second section 34*b* is directed into an optical cell 47 through which the sample tube 32 runs and is used to illuminate the fluid sample. A third bundle 34*d* collects light transmitted or scattered through the fluid sample and provides the filter spectrograph with the light for determining the absorption spectrum of the fluid sample. Optionally, though not necessarily preferred, a fourth fiber optic bundle 34*c* collects light substantially backscattered from the sample for spectrographic analysis. A three position solenoid (not shown) is used to select which fiber optic bundle is directed toward the filter spectrograph 39. Preferably, a light chopper (not shown) modulates the light directed at the spectrograph at 500 Hz to avoid low frequency noise in the detectors.

According to the invention, the pressure system 40 permits various pressures to be applied to the fluid sample in the fluid sample tube 32 at the vicinity of the optical cell 47. In particular, by shutting the valve 42 (and/or additional valves—not shown), and running the pump 44 in reverse, the pressure in the sample tube 32 can be caused to decrease from the ambient downhole pressure to a desired pressure which is measured by the pressure sensor 46. Similarly, by running the pump 44 in an ordinary fashion, the pressure of the sample in the sample tube 32 can be increased above the ambient pressure. Control of the pressure system 40 is preferably maintained uphole.

As mentioned above, optical bundle 34*b* directs the light towards the fluid sample. The fluid sample is obtained from the formation by the fluid admitting assembly and is sent to the fluid analysis section 25 in tube 32. The sample tube 32 is preferable a two by six millimeter rectangular channel which includes a section 50 with windows made of sapphire. This window section 50 is located in the optical cell 47 where the light rays are arranged to illuminate the sample. Sapphire is chosen for the windows because it is substantially transparent to the spectrum of the preferred light source and because it is highly resistant to abrasion. As indicated schematically in FIG. 2, the window areas 50 may be relatively thick compared to the rest of the tube 32 to withstand high internal pressure, The fiber optic buidles 32*b* and 32*d* are preferably not perpendicular to the window areas 50 so as to avoid specular reflection. The window areas are slightly offset as shown in FIG. 2 to keep them centered ii the path of the transmitted light. The signals from the detectors are digitized, multiplexed, and transmitted uphole via the cable 15 to the processing electronics 18 shown in FIG. 1.

Those skilled in the art will appreciate that each element in the detector array 38 is provided with a band pass filter for a particular wavelength band. According to a presently preferred embodiment, the detector array has ten elements which detect light at or about the following wavenumbers: 21000 $cm^{-1}$, 18600 $cm^{-1}$, 15450 $cm^{-1}$, 9350 $cm^{-1}$, 7750 $cm^{-1}$, 6920 $cm^{-1}$, 6250 $cm^{-1}$, 6000 $cm^{-1}$, 5800 $cm^{-1}$, and 5180 $cm^{-1}$. It will be appreciated that the first three wavenumbers represent visible blue, green, and red light and are preferably used to perform the type of analysis described in previously incorporated U.S. Pat. No. 5,266,800. The remaining wavenumbers are in the NIR spectrum and are used to perform analyses as described in various of the patents previously incorporated by reference herein as well as the analysis of this invention.

As previously indicated, the detector array elements determine the intensity of the light passing through the fluid in the tube 32 at the ten different wavebands. For purposes of the first embodiment of the present invention, however, and as described in detail below, it is only necessary that there be two detectors. The optical density of the fluid measured by any detector at any particular wavelength is determined according to Equation 1.

$$OD(\lambda) = \log\frac{I(\text{source})}{I(\lambda)} \tag{1}$$

Thus, if the measured intensity at wavelength λ is equal to the intensity of the source, there is no absorption, and the fraction in Equation 1 will be equal to 1 while the OD(λ) will equal 0. If the intensity at wavelength λ is one tenth the intensity of the source, the fraction in Equation 1 will be equal to 10 and the OD(λ) will equal 1. It will be appreciated that as the intensity at λ decreases, the optical density OD(λ) will increase.

According to the invention, the size of asphaltenes in an oil sample may be determined as a function of the optical densities of the sample measured at two or more wavelengths (λ1 and λ2). In particular, the wavelength dependence (g) of scattering of light of a similar wavelength to the diameter of the particles in the oil sample may be described according to $$g = \frac{\ln\left(\frac{OD_{\lambda 1test} - OD_{\lambda 1baseline}}{OD_{\lambda 2test} - OD_{\lambda 2baseline}}\right)}{\ln\frac{\lambda 1}{\lambda 2}} \tag{2}$$

where the subscripts "baseline" and "test" relate respectively to determinations of optical densities at a higher pressure where there preferably is no asphaltene precipitation and at a lower pressure where there preferably is asphaltene precipitation. Where the particles are large (r>>10 microns), it has been found that when λ1 and λ2 are in the near infrared (NIR) wavelength range of 1000 to 2500 nanometers, g will equal zero. Likewise, for very small particles (r<<1 micron), it has been found that g equals four in the NIR wavelengths. Intermediate values between zero and four are obtained when the radius of the particles corresponds well to the wavelength of the light. In fact, the wavelength dependence g is related to the radius r of the particle according to $$g = 4 + \frac{12(n^2 - 2)\alpha^2}{5(n^2 + 2) + 6(n^2 - 2)\alpha^2} \tag{3}$$

where n is the ratio of the indices of refraction of the discrete (particle) and continuous (liquid/oil) phase of the sample, and for dielectric spheres such as asphaltene $$\alpha = \frac{2\pi nr}{\lambda_{ave}} \tag{4}$$

with $\lambda_{ave}$ being the average of wavelengths λ1 and λ2. The indices of refraction of asphaltene particles and oil are well known (the index of refraction ≈1.7 for asphaltenes, and ≈1.4 for oil), and hence the ratio n≈1.2.

Figure 3:
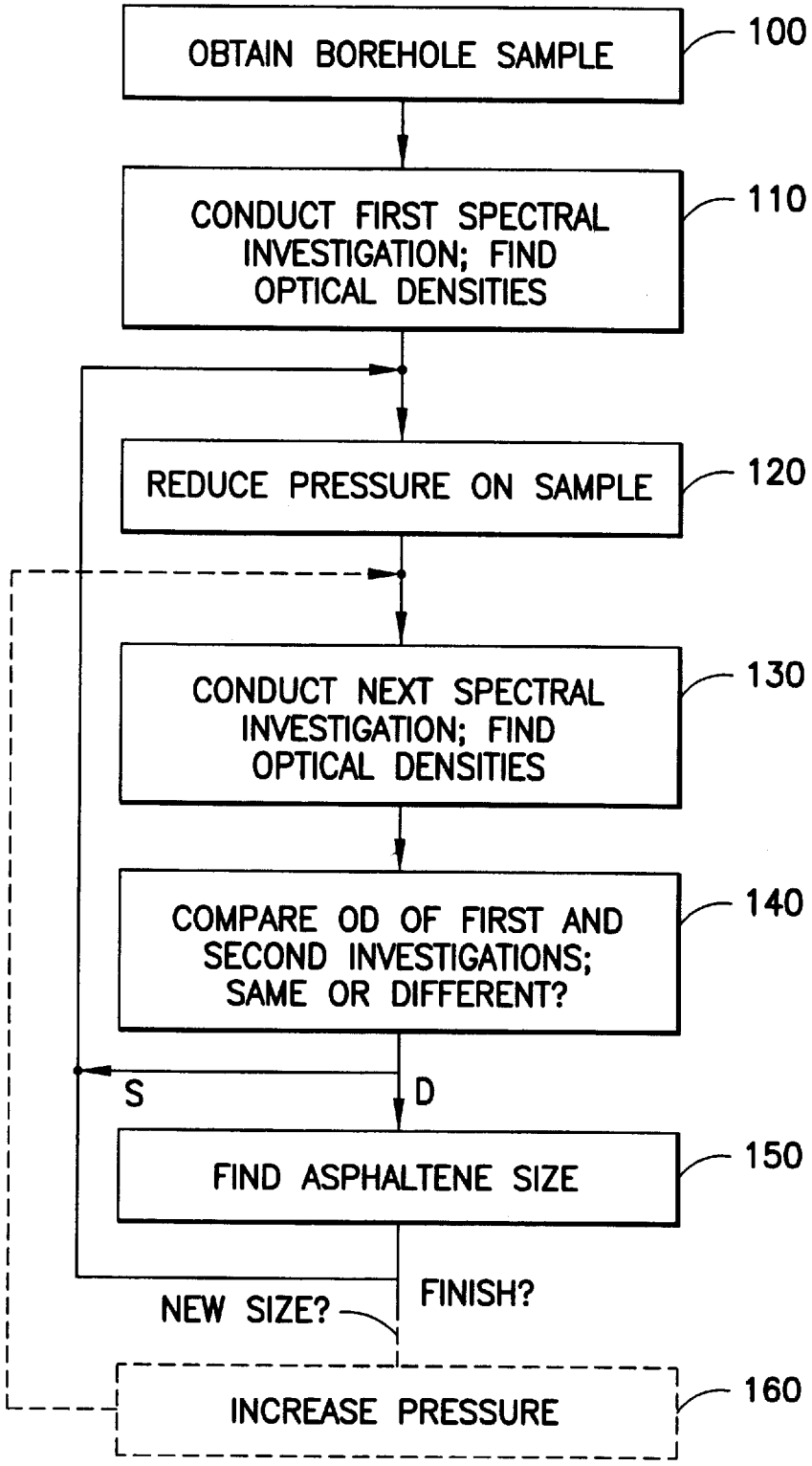
FIG. 3 is a flow chart representing a first method of the invention.

Turning now to FIG. 3, a method of the invention is seen. At step 100, an oil sample is obtained. The oil sample that is obtained may be located uphole or downhole, and may be obtained using the apparatus discussed above with reference to FIGS. 1 and 2, or by other apparatus. If uphole, the oil sample is preferably kept under pressure which approximates the ambient pressure at which it was obtained downhole. At the ambient pressure, at step 110, the oil sample is subjected to a first spectral investigation, and the optical densities ($OD_{baseline}$) at wavelengths of interest (λ1 and λ2) are determined. According to the presently preferred embodiment, and as will be described in more detail hereinafter with respect to FIG. 4, the wavelengths of interest are wavelengths of approximately 1115 nm, approximately 1310 nm, approximately 1500 nm, and any wavelength between approximately 1900 and approximately 2100 nm. Where the optical fluid analysis tool which has the detector array of ten elements is used as described above with reference to FIGS. 1 and 2, the optical elements which detect light at wavenumbers of 7750 $cm^{-1}$ (wavelength of 1290 nm which is approximately 1310 nm), and 5180 $cm^{-1}$ (wavelength of 1931 nm which is between 1900 and 2100 nm) are preferably used.

Figure 4:
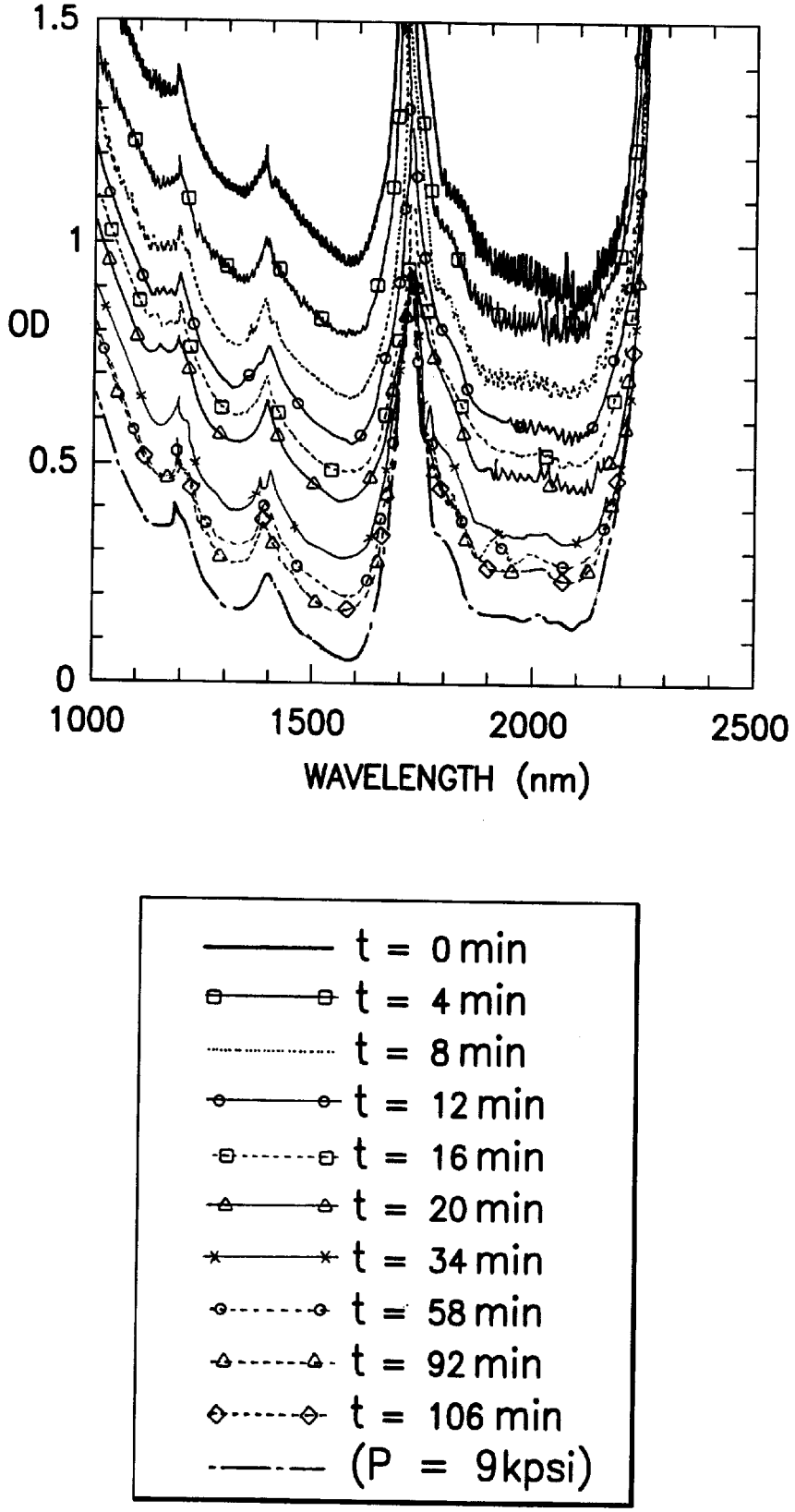
FIG. 4 is a graph of the optical density of an oil sample versus wavelength over a portion of the near infrared spectrum at a first pressure, and at a second pressure measured at several time intervals.

Returning to FIG. 3, at step 120, the pressure on the downhole sample is reduced, and at step 130, the optical densities ($OD_{test}$) at the wavelengths of interest are determined. At step 140, the optical density obtained at 110 for at least one of the wavelengths of interest is compared to the optical density for that wavelength obtained at step 130. If the optical densities are not different, it is because the asphaltenes are not precipitating, and the method of the invention continues at step 120. However, if the optical densities are different, it is because asphaltenes are precipitating. Indeed, as seen in FIG. 4, a reduction in pressure from 9 kpsi to 6 kpsi on a particular oil sample can cause precipitation which will cause a significant change in optical density over the entire spectrum. Over time, as the asphaltenes which are unstable at 6 kpsi precipitate out, it is seen that the optical density at any wavelength decreases towards the 9 kpsi optical density. Thus, it is desirable to make the optical density test measurements shortly after the pressure is changed on the sample. In addition, for measurement purposes, it is preferable to use optical density measurements obtained at wavelengths where there is relatively little change in optical density relative to adjacent wavelengths (e.g., in the valleys at about 1115 nm, 1310 nm, 1580 nm, and between 1900 and 2100 nm). In this manner, if there is any wavelength drift in the detectors, the optical density measurements will not be severely affected.

Returning again to FIG. 3, once a change in optical density is found, at step 150, using the determined baseline and test optical densities found at steps 110 and 130, the known wavelengths, and the known ratio of the indices of refraction (n), the radius (size) of the asphaltenes particles precipitating in the sample can be obtained using equations (2)–(4) above. It has been found that asphaltenes having a radius of one micron or less tend to be powdery without sticky resins, while asphaltenes of three microns or more tend to contain resins which contribute significantly to the "paving" or clogging of wells. It is believed that the reason for this difference is that asphaltenes themselves are not stable in oil and it is the resins which attach themselves to the asphaltenes which permit the asphaltenes to be suspended in the oil. Asphaltenes which have very little resin attached to them agglomerate less and are less stable, and therefore precipitate out of the crude oil more quickly (at a higher pressure). Asphaltenes with more resin, however, agglomerate to larger sizes, are more stable, and precipitate out of the crude oil only after the pressure on the oil is dropped more significantly. Thus, steps 100 through 150 of FIG. 3 may be repeated iteratively until a particular radius size (or sizes) of asphaltene precipitate is (are) identified.

As previously mentioned, the first method of the invention may be carried out uphole or downhole in both exploration and production environments. It will be appreciated by those skilled in the art, that whether conducted uphole or downhole, the method of the invention may be repeated for different oil samples. Thus, in the exploration environment, the borehole tool may be moved multiple times, and different oil samples obtained at different depths in the borehole. Where the samples are to be analyzed uphole, it is desirable to ascertain and record the ambient pressure at which the oil samples were obtained. In the production environment, samples may likewise be obtained at different locations along the wellbore, or samples may be obtained over a period of time at a particular location in the wellbore in order to monitor any changes in the mix of oil being produced. In all cases, it is desirable to ascertain information regarding the onset pressure of precipitation for resin-containing asphaltenes. This information may be used to set production parameters (e.g., to make sure that production pressures remain above the precipitation onset pressure of the resin-containing asphaltenes, or to determine that production will require use of chemicals, etc.).

Figure 5:
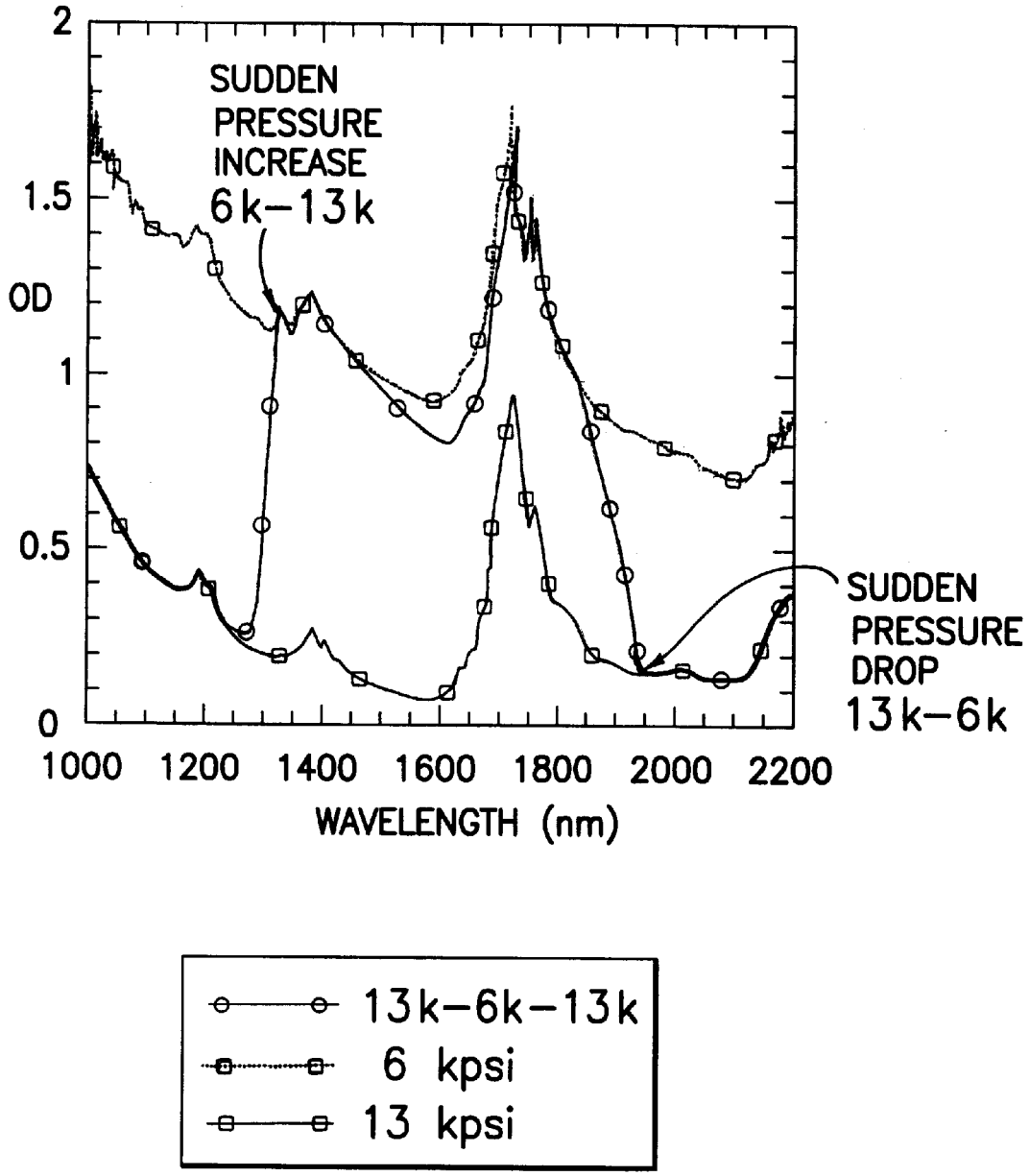
FIG. 5 is a graph of the optical density of an oil sample versus wavelength over a portion of the near infrared spectrum at two pressures which illustrates the reversibility of pressure-induced asphaltene precipitation.

According to another aspect of the invention, and contradictory to previous held beliefs, it has been found that the precipitation of the resin-containing asphaltenes is reversible under certain circumstances; i.e., resin-containing precipitate can be resuspended into the oil by increasing the pressure on the sample shortly after it precipitated, and providing that the pressure did not fall below the bubble point. This may be seen with reference to FIG. 5 where the spectrum at 13 kpsi shows no precipitation, while the spectrum at 6 kpsi exhibits significant scattering from asphaltene flocculation. A spectral scan (long to short wavelength) was performed and is displayed in FIG. 5 which shows formation of asphaltene flocs with a pressure drop at a time corresponding to 1930 nm and a deflocculation with a pressure increase at a time in the scan corresponding to 1300 nm.

Returning once more to FIG. 3, by increasing the pressure on the sample as suggested by optional step 160, and returning to steps 130, 140, and 150, the resuspension of different-sized asphaltenes agglomerations can be tracked. The value in reversing the precipitation process is two-fold. First, since light scattering may be induced by mud solids and other suspensions in the oil sample, light scattering due to asphaltene precipitation may be differentiated from other processes because only scattering from asphaltene will follow a pressure cycle (i.e., mud and other suspension typically do not precipitate). Second, the method of the invention typically will be run for multiple oil samples at the same or different borehole depths. Between each sample, it is necessary to open the valve, expel the sample, and take a new sample. Since it is desirable to bring the pressure of the system back to ambient pressure before opening the valve, the oil sample will be repressurized anyway. Therefore, the obtaining of additional information during repressurization provides a more robust analysis of the sample. If the information regarding size of precipitate versus pressure is not the same in each direction, the test can be rerun.

A second method of the invention also utilizes optical density infonnation to find the size of precipitating particles. The second method utilizes the Stokes equation:

$$V = \frac{2r^2(\rho - \rho_s)a}{9\eta} \tag{5}$$

where V is velocity of a precipitating particle, r is the radius of the particle, a is the gravity constant (9.8 m/sec$^2$), $\eta$ is the viscosity of the oil, $\rho$ is the density of the asphaltene particle, and $\rho$, is the density of the oil. In particular, the velocity V is experimentally determined by changing the pressure on the oil sample and then determining the amount of time it takes for the optical density to change (as seen in FIG. 4) from a maximum value to a threshold value which is a percentage (e.g., 1/e) of the difference between a baseline valut and a maximum value. This time represents an indication of the actual movement of the asphaltene as it precipitates to the bottom of the oil sample chamber so that it can no longer scatter the light. The height (d) of the chamber in which the oil sample is stored is then divided by this time value to provide the velocity. Because the densities of the asphaltene particle and oil and the viscosity of the oil can be taken as constants or may be otherwise determined, by finding the velocity, the radius of the asphaliene particles can be determined from the Stokes equation.

Figure 6:
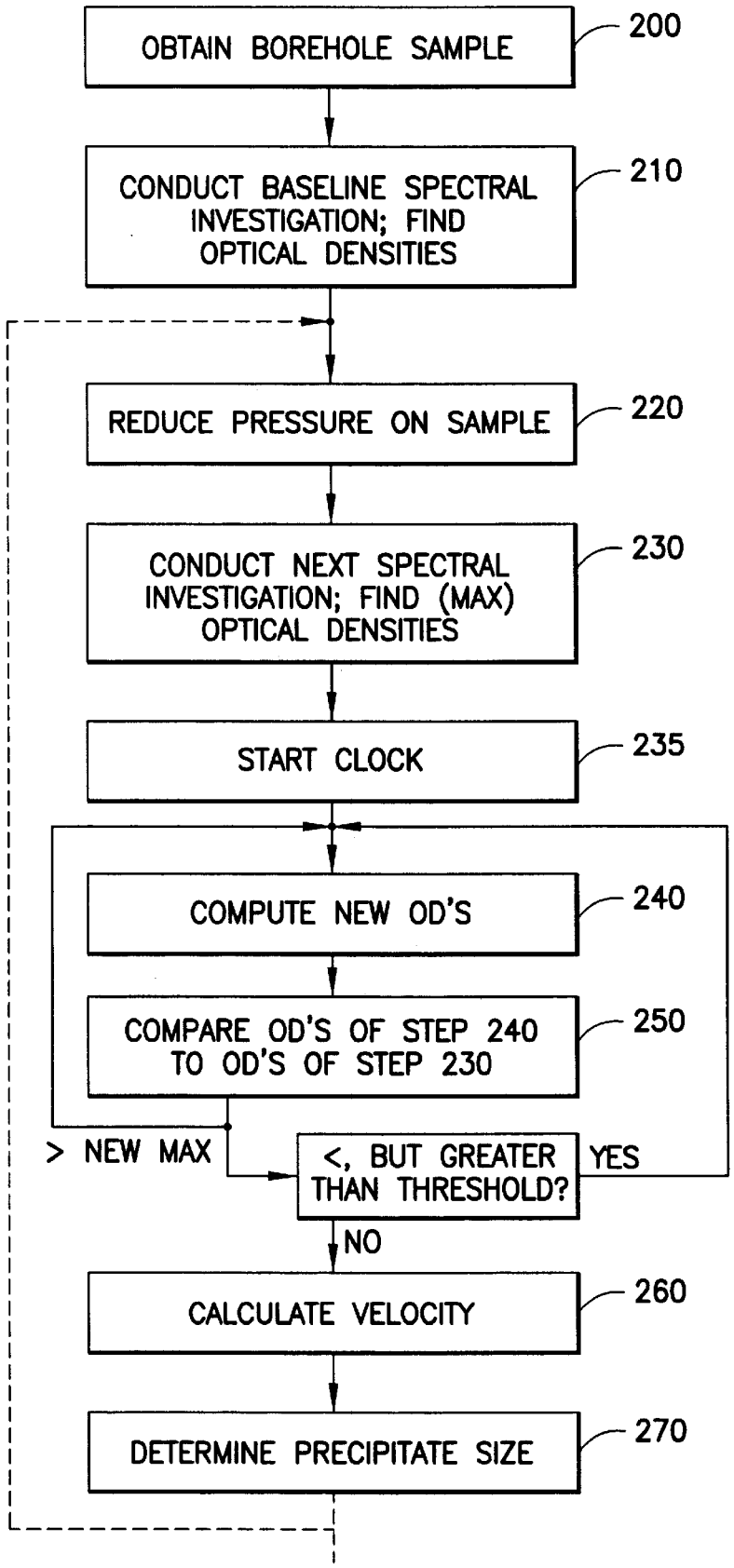
FIG. 6 is a flow chart representing a second method of the invention.

The second method of the invention is seen in flow-chart form in FIG. 6. At step 200, an oil sample is obtained. The oil sample that is obtained may be located uphole or downhole, and may be obtained using the apparatus discussed above with reference to FIGS. 1 and 2, or by other apparatus or means. The oil sample is then subjected to a first baseline spectral investigation at the ambient pressure at step 210, and the optical density at one wavelength (and preferably multiple wavelengths) of interest is/are determined. At step 220, the pressure on the sample is changed, and at step 230, an optical density value for each wavelength of interest at the new pressure is determined and taken as a maximum value. At step 235 a clock is started, and at step 240, after a period of time (e.g., 1 minute), a new optical density value is computed for each wavelength. The new optical density value at each wavelength is compared at step 250 to the respective values found at 230. If the OD values found at 240 are greater than the values at 230, they are taken as new maxima. If the OD value for a given wavelength found at 240 is less than the previously determined maximum for that wavelength, the value is compared to a respective threshold value which is preferably a function of the maximum (e.g., 1/e times the difference of the maximum and baseline). If it is greater than the threshold value, the method returns to step 240 where a new optical density value is computed for each wavelength of interest. The method cycles through steps 240 and 250 until the new OD values are less than the threshold value. When that occurs, the time it took to reach the threshold is used in conjunction with the known height of the optical sample chamber to calculate at 260 the velocity of the precipitates. Then, at step 270, the radius of the precipitating sample is calculated according to the Stokes equation. The second method may then continue at step 220 with another change in the pressure, and a cycling through steps 230–270. It will be appreciated by those skilled in the art that steps 260 and 270 may easily be combined.

The second method of the invention may be utilized on its own either uphole or downhole, or may be in conjunction with the first method of the invention. When used in conjunction with the first method of the invention, the second method may provide validation to the determinations of the first method.

In conjunction with the methods of the invention (primarily the first method), it may be desirable to gently agitate the oil sample during testing via use of mechanical or ultrasonic means (not shown). Typically, mechanical means might be more readily utilized uphole, and ultrasonic means downhole. The purpose of a gentle agitation is to prevent the asphaltene precipitation from suffering some degree of nonequilibrium behavior (similar to supercooling in water). Asphaltene precipitation technically is not a phase transition, and the asphaltenes are not dissolved solids. Instead, asphaltene precipitation corresponds to the destabilization of a microcolloidal suspension. Thus, technically, the same thermodynamic impediments to phase transitions and creation of new surfaces should not be nearly as important as in other nonequilibrium situations such as supercooling applications. However, in order to avoid the possibility of nonequilibrium behavior, gentle agitation may be utilized.

There have been described and illustrated herein several embodiments of methods and apparatus for determining asphaltene precipitation onset. While particular embodiments of the invention have been described, it is not intended that the invention be limited thereto, as it is intended that the invention be as broad in scope as the art will allow and that the specification be read likewise. Thus, while the invention has been described with reference to a borehole logging apparatus which is typically moved to different locations of the borehole for logging results as a function of borehole depth, it will be appreciated that the invention may be carried out uphole (e.g., in a laboratory) or in a hydrocarbon production environment by a production-logging tool, or by a permanent sensor type system (which is typically cemented in place). Also, while the invention has been described with reference to a particular borehole logging apparatus, it will be recognized that in the borehole environment other types of borehole apparatus could be used to make spectral analyses of formation fluids in accord with the concepts of the invention. Thus, while a particular light source and spectral detector have been disclosed, it will be appreciated that other spectral detectors and light sources could be utilized provided that they perform the same functions as described herein. Also, while the invention was described with particular examples of desired wavelengths of investigation, it will be appreciated that other wavelengths can be utilized, including wavelengths in the visible spectrum, and that it is preferable to conduct investigations using more than two wavelengths if possible. Moreover, while particular steps have been disclosed in reference to the methods of the invention, it will be appreciated by those skilled in the art that various of the steps can be carried out in different order, and some of the steps can be combined. For example, because precipitation has been found to be reversible in certain circumstances, data regarding precipitation can be obtained prior to finding a baseline. Further, it will be appreciated that the equations utilized in conducting the methods of the invention may be expressed in different manners. For example, rather than expressing the wavelength dependence (g) of scattering in terms of optical density, the wavelength dependence can be expressed in terms of measured energy or intensity (i.e., combining equations (1) and (2)). Thus, for purposes of this application, including the claims, the measurement of the light energy at a given wavelength should be considered the equivalent of the measurement of the optical density at that wavelength. Further yet, and with particular reference to the second method of the invention, while certain methods for determining particle velocity have been described, it will be appreciated that other threshold values and/or techniques can be utilized to find the particle velocity. For example, it is possible to provide other equipment which would utilize multiple light beams separated by known vertical distances in order to characterize the velocity of sedimentation. It will therefore be appreciated by those skilled in the art that yet other modifications could be made to the provided invention without deviating from its spirit and scope as so claimed.

We claim:

1. A method of determining the size of asphaltene particles precipitating in a sample of oil obtained from a formation, comprising the steps of:

a) illuminating the sample with light at first and second different wavelengths at at least one intensity;

b) measuring optical energies at said first and second different wavelengths of light transmitted through the sample;

c) changing pressure on the sample to cause precipitation of asphaltene particles;

e) repeating steps a) and b) at the changed pressure; and f) determining the size of the asphaltene particles precipitating from the sample as a function of the measured optical energies.

2. A method according to claim 1, wherein:

said function is also a function of said first and second wavelengths.

3. A method according to claim 2, wherein:

said function is also a function of a ratio of the indices of refraction of the asphaltene particles and the oil.

4. A method according to claim 2, wherein:

said function is also a function of the intensity of said illuminating at said first and second different wavelengths.

5. A method according to claim 1, wherein:

said determining comprises finding baseline optical densities of said oil sample at said first and second wavelengths, finding test optical densities of said oil sample at said first and second wavelengths at the changed pressure, relating a wavelength dependence of scattering of light to a function of said first and second wavelengths, and said baseline and test optical densities of said oil sample, and relating said wavelength dependence to said asphaltene particle size.

6. A method according to claim 5, wherein:

said wavelength dependence of scattering of light is related to said first and second wavelengths according to $$g = \frac{\ln\left(\frac{OD_{\lambda 1test} - OD_{\lambda 1baseline}}{OD_{\lambda 2test} - OD_{\lambda 2baseline}}\right)}{\ln\frac{\lambda 1}{\lambda 2}}$$

where g is said wavelength dependence of scattering of light, $\lambda 1$ and $\lambda 2$ are said first and second different wavelenghs, and OD is the optical density for its stated subscript.

7. A method according to claim 6, wherein:

said wavelength dependence is related to said asphaltene particle size according to $$g = 4 + \frac{12(n^2 - 2)\alpha^2}{5(n^2 + 2) + 6(n^2 - 2)\alpha^2}$$

when n is a ratio of the indices of refraction of the asphaltene particles and the oil, and $$\alpha = \frac{2\pi nr}{\lambda_{ave}},$$

with $\lambda_{ave}$ being the average of wavelengths $\lambda 1$ and $\lambda 2$, and r being the radius of the asphaltene particles.

8. A method according to claim 7, wherein:

n is selected to be approximately 1.2.

9. A method according to claim 1, wherein:

said first and second wavelengths are chosen in the near infrared spectrum.

10. A method according to claim 9, wherein:

said first and second wavelengths are chosen from a group of wavelengths including approximately 1115 nm, approximately 1310 nm, approximately 1580 nm, and approximately 1900 nm to approximately 2100 nm.

11. A method according to claim 1, wherein:

said first and second wavelengths are chosen to be within an order of magnitude of the radius of the particle size being measured.

12. A method according to claim 1, wherein:

said illumination is conducted in a borehole or wellbore of the formation.

13. A method according to claim 12, further comprising:

prior to said step of illuminating, obtaining said sample of formation oil with a borehole tool which is movable in a borehole or wellbore in the formation.

14. A method according to claim 12, further comprising:

prior to said step of illuminating, isolating said sample of formation oil in a fixed cell in a wellbore in the formation.

15. A method according to claim 1, wherein:

said illumination is conducted uphole out of the formation.

16. A method according to claim 1, wherein:

said step of illuminating comprises illuminating at at least three different wavelengths, said step of measuring comprises measuring optical energies at said at least three different wavelengths, and said step of determining comprises making a plurality of determinations of the size of the asphaltene particles precipitating from the sample, each of said plurality of determinations being made as a function of two different measured optical energies.

17. A method according to claim 1, wherein:

said function is also a function of a density of said asphaltene particles, a density of said oil, and a viscosity of said oil.

18. A method according to claim 17, wherein:

said function is also a function of the intensity of said illuminating at said first and second different wavelengths.

19. A method according to claim 1, wherein:

said determining comprises using said optical energies at said first and second different wavelengths to find a velocity of said asphaltene particles precipitating in said oil sample, and relating said velocity to the size of the asphaltene particles.

20. A method according to claim 19, wherein:

said velocity (V) is related to said size of the asphaltene particles (r) according to $$V = \frac{2r^2(\rho - \rho_s)a}{9\eta},$$

where a is the gravity constant, $\eta$ is the viscosity of the oil, $\rho$ is the density of the asphaltene particle, and $\rho_s$ is the density of the oil.

21. A method according to claim 19, wherein:

said velocity is determined by repeating steps a) and b) at the changed pressure a plurality of times and finding how long it takes for an indication of said optical energies to change a certain amount, and dividing a dimension of a cell in which said sample is located by that length of time.

22. A method according to claim 21, wherein:

said length of time is the length of time it takes for the optical energy to increase from a measured minimum value which represents a maximum optical density after said pressure is changed at step c), to a threshold value.

23. A method according to claim 22, wherein:

said threshold value is a fraction of a difference between said maximum optical density and a baseline optical density.

24. A method of finding the precipitation onset pressure of asphaltene particles of a desired size in an oil sample, comprising the steps of:

a) illuminating the sample with light at first and second different wavelengths at at least one intensity;

b) measuring optical energies at said first and second different wavelengths of light transmitted through the sample;

c) changing pressure on the sample to cause precipitation of asphaltene particles;

e) repeating steps a) and b) at the changed pressure;

f) determining the size of the asphaltene particles precipitating from the sample as a function of the measured optical energies; and g) repeating steps a) through f) until the size determined at step f) is said desired size.

25. A method according to claim 24, further comprising:

prior to said step of illuminating, isolating said oil sample downhole in a borehole or wellbore of a formation.

26. A method according to claim 25, further comprising:

after step g), isolating another oil sample and repeating steps a) through g) for said another oil sample.

27. A method according to claim 24, wherein:

said function is also a function of said first and second wavelengths, a ratio of the indices of refraction of the asphaltene particles and the oil, and the intensity of said illuminating at said first and second different wavelengths.

28. A method according to claim 24, wherein:

said determining comprises finding baseline optical densities of said oil sample at said first and second wavelengths, finding test optical densities of said oil sample at said first and second wavelengths at the changed pressure, relating a wavelength dependence of scattering of light to a function of said first and second wavelengths, and said baseline and test optical densities of said oil sample, and relating said wavelength dependence to said asphaltene particle size.

29. A method according to claim 28, wherein:

said wavelength dependence of scattering of light is related to said first and second wavelengths according to $$g = \frac{\ln\left(\frac{OD_{\lambda 1test} - OD_{\lambda 1baseline}}{OD_{\lambda 2test} - OD_{\lambda 2baseline}}\right)}{\ln\frac{\lambda 1}{\lambda 2}}$$

where g is said wavelength dependence of scattering of light $\lambda 1$ and $\lambda 2$ are said first and second different wavelengths, and OD is the optical density for its stated subscript.

30. A method according to claim 29, wherein:

said wavelength dependence is related to said asphaltene particle size according to $$g = 4 + \frac{12(n^2 - 2)\alpha^2}{5(n^2 + 2) + 6(n^2 - 2)\alpha^2}$$

where n is a ratio of the indices of refraction of the asphaltene particles and the oil, and $$\alpha = \frac{2\pi nr}{\lambda_{ave}},$$

with $\lambda_{ave}$ being the average of wavelengths $\lambda 1$ and $\lambda 2$, and r being the radius of the asphaltene particles.

31. A method according to claim 24, wherein:

said first and second wavelengths are chosen in the near infrared spectrum from a group of wavelengths including approximately 1115 nm, approximately 1310 nm, approximately 1580 nm, and approximately 1900 nm to approximately 2100 nm.

32. A method according to claim 24, wherein:

said function is also a function of a density of said asphaltene particles, a density of said oil, a viscosity of said oil, and the intensity of said illuminating at said first and second different wavelengths.

33. A method according to claim 24, wherein:

said determining comprises using said optical energies at said first and second different wavelengths to find a velocity of said asphaltene particles precipitating in said oil sample, and relating said velocity to the size of the asphaltene particles.

34. A method according to claim 33, wherein:

said velocity (V) is related to said size of the asphaltene particles (r) according to $$V = \frac{2r^2(\rho - \rho_s)a}{9\eta},$$

where a is the gravity constant, $\eta$ is the viscosity of the oil, $\rho$ is the density of the asphaltene particle, and $\rho_s$ is the density of the oil.

35. A method according to claim 33, wherein:

said velocity is determined by repeating steps a) and b) at the changed pressure a plurality of times and finding how long it takes for an indication of said optical energies to change a certain amount, and dividing a dimension of a cell in which said sample is located by that length of time.

36. A method according to claim 35, wherein:

said length of time is the length of time it takes for the optical energy to increase from a measured minimum value which represents a maximum optical density after said pressure is changed at step c), to a threshold value.

37. A method according to claim 36, wherein:

said threshold value is a fraction of a difference between said maximum optical density and a baseline optical density.

38. A method of determining the size of asphaltene particles precipitating in a sample of oil obtained from a formation, comprising the steps of:

a) illuminating the sample with light at at least a first wavelength at a first intensity;

b) measuring optical energy at said first wavelength of light transmitted through the sample;

c) changing pressure on the sample to cause precipitation of asphaltene particles;

e) repeating steps a) and b) at the changed pressure; and f) determining the size of the asphaltene particles precipitating from the sample as a function of the measured optical energies at said first wavelength by using said measured optical energies at said first wavelength to find a velocity of said asphaltene particles precipitating in said oil sample, and relating said velocity to the size of the asphaltene particles.

39. A method according to claim 38, wherein:

said function is also a function of a density of said asphaltene particles, a density of said oil, and a viscosity of said oil.

40. A method according to claim 38, wherein:

said velocity (V) is related to said size of the asphaltene particles (r) according to $$V = \frac{2r^2(\rho - \rho_s)a}{9\eta},$$

where a is the gravity constant, $\eta$ is the viscosity of the oil, $\rho$ is the density of the asphaltene particle, and $\rho_s$ is the density of the oil.

41. A method according to claim 38, wherein:

said velocity is determined by repeating steps a) and b) at the changed pressure a plurality of times and finding how long it takes for an indication of said optical energy to change a certain amount, and dividing a dimension of a cell in which said sample is located by that length of time.

42. A method according to claim 41, wherein:

said length of time is the length of time it takes for the optical energy to increase from a measured minimum value which represents a maximum optical density after said pressure is changed at step c), to a threshold value.

43. A method according to claim 42, wherein:

said threshold value is a fraction of a difference between said maximum optical density and a baseline optical density.

44. An apparatus for determining the size of asphaltene particles precipitating in a sample of oil obtained from a formation, comprising:

a) an optical cell for holding the sample of oil;

b) means optically coupled to said optical cell for illuminating the sample with light at first and second different wavelengths at at least one intensity;

c) means optically coupled to said optical cell for measuring optical energies at said first and second different wavelengths of light transmitted through the sample;

d) means fluidly coupled to said optical cell for changing pressure on the sample of oil to cause precipitation of asphaltene particles; and e) means for determining the size of the asphaltene particles precipitating from the sample as a function of the measured optical energies.

45. An apparatus according to claim 44, wherein:

said means for changing pressure is adapted to change pressure multiple times at least until said means for determining the size of the asphaltene particles precipitating from the sample determines that the size of said asphaltene particles is a desired size.

46. An apparatus according to claim 44, further comprising:

e) means for isolating the oil sample downhole in a borehole or wellbore of a formation.

47. An apparatus according to claim 44, wherein:

said function is also a function of said first and second wavelengths, a ratio of the indices of refraction of the asphaltene particles and the oil, and the intensity of said illuminating at said first and second different wavelengths.

48. An apparatus according to claim 46, wherein:

said means for determining comprises means for finding baseline optical densities of said oil sample at said first and second wavelengths, for finding test optical densities of said oil sample at said first and second wavelengths at the changed pressure, for relating a wavelength dependence of scattering of light to a function of said first and second wavelengths, and said baseline and test optical densities of said oil sample, and for relating said wavelength dependence to said asphaltene particle size.

49. An apparatus according to claim 48, wherein:

said wavelength dependence of scattering of light is related to said first and second wavelengths according to $$g = \frac{\ln\left(\frac{OD_{\lambda 1test} - OD_{\lambda 1baseline}}{OD_{\lambda 2test} - OD_{\lambda 2baseline}}\right)}{\ln\frac{\lambda 1}{\lambda 2}}$$

where g is said wavelength dependence of scattering of light, $\lambda 1$ and $\lambda 2$ are said first and second different wavelengths, and OD is the optical density for its stated subscript.

50. An apparatus according to claim 49, wherein:

said wavelength dependence is related to said asphaltene particle size according to $$g = 4 + \frac{12(n^2 - 2)\alpha^2}{5(n^2 + 2) + 6(n^2 - 2)\alpha^2}$$

where n is a ratio of the indices of refraction of the asphaltene particles and the oil, and $$\alpha = \frac{2\pi nr}{\lambda_{ave}},$$

with $\lambda_{ave}$ being the average of wavelengths $\lambda 1$ and $\lambda 2$, and r the radius of the asphaltene particles.

51. An apparatus according to claim 44, wherein:

said first and second wavelengths are chosen in the near infrared spectrum from a group of wavelengths including approximately 1115 nm, approximately 1310 nm, approximately 1580 nm, and approximately 1900 nm to approximately 2100 nm.

52. An apparatus according to claim 44, wherein:

said function is also a function of a density of said asphaltene particles, a density of said oil, a viscosity of said oil, and the intensity of said illuminating at said first and second different wavelengths.

53. An apparatus according to claim 44, wherein:

said means for determining comprises means for using said optical energies at said first and second different wavelengths to find a velocity of said asphaltene particles precipitating in said oil sample, and for relating said velocity to the size of the asphaltene particles.

54. An apparatus according to claim 53, wherein:

said means for relating relates said velocity (V) to said size of the asphaltene particles (r) according to $$V = \frac{2r^2(\rho - \rho_s)a}{9\eta},$$

where a is the gravity constant, $\eta$ is the viscosity of the oil, $\rho$ is the density of the asphaltene particle, and $\rho_s$ is the density of the oil.

55. An apparatus according to claim 52, wherein:

said means for determining includes means for timing a length of time it takes for an indication of said optical energies to change a certain amount, and dividing a dimension of said cell by that length of time.

56. An apparatus according to claim 55, wherein:

said length of time is the length of time it takes for the optical energy to increase from a measured minimum value which represents a maximum optical density after said pressure is changed by said means for changing pressure to a threshold value.

57. An apparatus according to claim 56, wherein:

said threshold value is a fraction of a difference between said maximum optical density and a baseline optical density.

58. An apparatus for determining the size of asphaltene particles precipitating in a sample of oil obtained from a formation, comprising:

a) an optical cell for holding the sample of oil;

b) means optically coupled to said optical cell for illuminating the sample with light at at least a first wavelength at a first intensity;

c) means optically coupled to said optical cell for measuring optical energy at said first wavelength of light transmitted through the sample;

d) means fluidly coupled to said optical cell for changing pressure on the sample of oil to cause precipitation of asphaltene particles; and e) means for determining the size of the asphaltene particles precipitating from the sample as a function of the measured optical energies at said first wavelength at different pressures by using said measured optical energies at said first wavelength to find a velocity of said asphaltene particles precipitating in said oil sample, and for relating said velocity to the size of the asphaltene particles.

59. An apparatus according to claim 58, wherein:

said function is also a function of a density of said asphaltene particles, a density of said oil, and a viscosity of said oil.

60. An apparatus according to claim 58, wherein:

said means for relating relates said velocity (V) to said size of the asphaltene particles (r) according to $$V = \frac{2r^2(\rho - \rho_s)a}{9\eta},$$

where a is the gravity constant, $\eta$ is the viscosity of the oil, $\rho$ is the density of the asphaltene particle, and $\rho_s$ is the density of the oil.

61. An apparatus according to claim 58, wherein:

said means for determining includes means for timing a length of time it takes for an indication of said optical energies to change a certain amount, and dividing a dimension of said cell by that length of time.

62. An apparatus according to claim 61, wherein:

said length of time is the length of time it takes for the optical energy to increase from a measured minimum value which represents a maximum optical density after said pressure is changed by said means for changing pressure to a threshold value.

63. An apparatus according to claim 62, wherein:

said threshold value is a fraction of a difference between said maximum optical density and a baseline optical density.

* * * * *